US006326746B1

(12) United States Patent
Chen

(10) Patent No.: US 6,326,746 B1
(45) Date of Patent: Dec. 4, 2001

(54) HIGH EFFICIENCY RESONATOR FOR LINEAR ACCELERATOR

(75) Inventor: Jiong Chen, San Jose, CA (US)

(73) Assignee: Advanced Ion Beam Technology, Inc., Sunnyvale, CA (US)

( * ) Notice: Subject to any disclaimer, the term of this patent is extended or adjusted under 35 U.S.C. 154(b) by 0 days.

(21) Appl. No.: 09/602,765

(22) Filed: Jun. 23, 2000

Related U.S. Application Data

(60) Provisional application No. 60/140,494, filed on Jun. 23, 1999.

(51) Int. Cl.[7] ..... H05H 9/00

(52) U.S. Cl. ..... 315/505; 315/5.41; 315/5.42

(58) Field of Search ..... 315/5.41, 5.42, 315/5.52, 5.51, 500, 505, 501, 39.65, 39.51, 5.48, 5.63, 39.69

(56) References Cited

U.S. PATENT DOCUMENTS 4,392,080 * 7/1983 Maschke ..... 315/5.41
4,667,111 * 5/1987 Glavish et al. ..... 250/492.2
5,280,252 * 1/1994 Inoue et al. ..... 328/233
5,504,341 * 4/1996 Glavish ..... 250/492.21
5,825,140 * 10/1998 Fujisawa ..... 315/505

* cited by examiner

*Primary Examiner*—Don Wong
*Assistant Examiner*—Tuyet T. Vo
(74) *Attorney, Agent, or Firm*—Bo-In Lin

(57) ABSTRACT

A new radio frequency (rf) linear accelerator (linac) is disclosed in this invention. The rf linac includes a plurality of resonators each includes an inductor circuit L(k), k=1,2, 3, . . . , n' where n' is a second integer, wherein the inductor circuit connected to at least two electrodes E(j'), j'=1,2,3, . . . (n−1), for applying an accelerating rf voltage thereto. The rf linac further includes a plurality sets of transverse focusing lenses, represented by Lenses(j), where j=1,2,3, . . . n, and n is an integer, for guiding and focusing an ion beam. Each of the electrodes E(j') disposed between and aligned with two sets of the transverse focusing lenses Lenses(J') and Lenses(J'+1), j'=1,2,3, . . . (n−1), as a linear array. In a preferred embodiment, at least two of the adjacent electrodes E(j') and E(j'+1) are connected to a same inductor circuit L(k). In another preferred embodiment, at least two of the adjacent electrodes E(j') and E(j'+1) are connected to two different inductor circuits L(k1) and L(k2) where k1 and k2 are two different integers and k1 and k2 are smaller than n'. The energy gain from a resonator of this invention is twice or multiple of the energy gain from a single-electrode resonator with the same rf power efficiency.

20 Claims, 3 Drawing Sheets

HIGH EFFICIENCY RESONATOR FOR LINEAR ACCELERATOR

This Application claimed a priority filing date of Jun. 23,1999 benefited from a Provisional Application 60/140, 494 filed on Jun. 23, 1999 by the same inventor of this Formal Application.

BACKGROUND OF THE INVENTION

1. Field of the Invention

This invention relates generally to radio frequency (rf) linear accelerator (linac). Specifically, this invention relates to rf power system for generating high voltages on electrodes to accelerate ion beams.

2. Description of the Prior Art

Strong rf electromagnetic fields, bounded by resonant cavities, are commonly used in particle accelerator systems to accelerate charged particle beams. Gustav Ising proposed the first accelerator that used time-dependent fields in 1924[i]. The concept proposed by Ising was not tested at that time until Rolf Wideröe conceived and demonstrated experimentally the first RF linear accelerator in 1927[ii]. The linac built by Wideröe was the forerunner of all modern RF accelerators. Wideröe's concept was to apply a time-alternating voltage to a sequence of drift tubes whose lengths increased with increasing particle velocity, so that the particles would arrive in every gap at the right time to be accelerated.

In Wideröe's experiment, an rf voltage of 25 kV from a 1-MHz oscillator was applied to a single drift tube between two grounded electrodes, and a beam of singly charged potassium ions gained the maximum energy in each gap. A final beam-energy of 50 keV was measured, which was twice that obtainable from a single application of the applied voltage. This was also the first accelerator that had ground potential at both the entrance and the exit ends, and was still able to deliver a net energy gain to the beam, using the electric fields within. The experiment established the principle that unlike an electrostatic accelerator, the voltage gain of an rf accelerator could exceed the maximum applied voltage.

Wideröe's experiment had great influence on modern linacs. In 1931, Sloan and Lawrence built a Wideröe-type linac with 30 drift tubes and by applying 42 kV at a frequency of 10 MHz, they accelerated mercury ions to an energy of 1.26 MeV[iii]. Luis Alvarez and co-workers proposed[iv] and built[v] a 1-m-diameter 12-m-length drift-tube linac (DTL) at a frequency of 200 MHz, which accelerated protons from 4 MeV to 32 MeV. Kapchinskly and Tepliakov first presented the principles of operation of a radio-frequency quadrupole linac (RFQ)[vi], which had four electrodes with modulated shapes to produce transverse and longitudinal electric fields to achieve both focusing and acceleration of charged particle beams.

Linac technology has been used for accelerating ions up to MeV range for ion implantation application since 1980[vii]. The recent development of linac is focused on improvement of linac power efficiency to reduce build cost and power consumption[viii,ix]. Except the RFQ linacs, which have very small mass and energy range, a linac used in ion implantation is very similar to Wideröe's linac and consists of individual rf electrodes that can accelerate ion beams up to MeV energies (FIG. 1). Each electrode can be driven to a very high voltage (40~100 kV) by a resonant LC circuit The resonant circuit including a coil, electrode, and enclosure wall, is referenced to as a resonator. The merit of the individual resonator configuration is that each resonator can be independently tuned and the linac has more flexibility for accelerating ion species with different masses and charge states to achieve the desired ion energy.

However, each resonator system, including the resonator, rf amplifier, and tuning electronics is very expensive. A resonator also consumes several kilowatts of electric power. Most of the power is dissipated as heat inside the resonator and less than 5% of the electric power can be used to accelerate the ion beams.

Increasing power efficiency of a resonator can reduce power consumption and the cost of rf amplifiers if the final ion energy is kept unchanged. For the same power consumption per resonator, higher power efficiency also means higher output voltage on the rf electrode, resulting higher energy gain per resonator. The number of resonators can be reduced for the same final ion energy. Glavish claimed that his single electrode resonator could deliver 95 kV rf voltage on the electrode with 2.6 kW rf input power[8]. Since there were two rf acceleration gaps in this single-electrode resonator system, the maximum energy gain per input power square root (since rf voltage square is proportional to rf power) is 118 $keV/(kW)^{1/2}$ for a singly-charged ion. A single-electrode resonator in Eaton's most recent high-energy rf linac could deliver 80 kV rf voltage with 3.0 kW input power. The maximum energy gain per input power would be 92 $kV/(kW)^{1/2}$.

Increasing the number of acceleration gaps is another way to increase energy gain per input power. Fujisawa's triple-gap rf resonator could obtain energy gain of 216 kV at input power of 5 kW[xi]. The energy gain per input power was 97 $kV/(kW)^{1/2}$.

The above mentioned double-gap and triple-gap resonators have energy gain per input power around 100 $kV/(kW)^{1/2}$ proven by beam tests while Glavish's resonator has so far no supporting ion beam experimental data for proving the claim of a high efficiency. Conventional techniques of ion beam acceleration according to above brief survey of the prior art techniques illustrates that there are still limitations now encountered by those involved in design and manufacturing a linear ion accelerator. These prior art techniques do not provide a viable solution to enable a person of ordinary skill in the art to overcome these limitations. Therefore, it is necessary to use a new approach to increase the acceleration efficiency over the limitation of the state of the art The present invention of double-electrode resonator demonstrates a new concept for ion beam acceleration with the purposes and objects of providing much higher acceleration efficiency.

SUMMARY OF THE PRESENT INVENTION

It is the object of the present invention to provide a new ion acceleration system for improved the ion acceleration efficiency by reducing the required number of resonators employed for an ion accelerator system. The new rf linear acceleration system is implemented with a new configuration by connecting at least two electrodes to an inductive circuit of the resonator. The number of inductive circuits (or resonators) required for generating high voltage rf resonating voltages are reduced and cost savings are achieved with this new configuration.

Specifically, it is an object of the present invention to present a new radio frequency (rf) linear accelerator system implemented with multiple electrodes connected to an inductive circuit of the resonator. The geometry between the electrode and the focusing lenses are arranged to produce maximum acceleration by taking into account of the ion velocity, the frequency of the resonator and the mass/charge ratio of the ion particles. Improved acceleration efficiency is achieved so that we can reduce the power input required for each electrode.

Briefly, in a preferred embodiment, the present invention discloses a radio frequency (rf) linear accelerator (linac). The rf linac includes a plurality sets of transverse focusing lenses, represented by Lenses(j), where j=1,2,3, . . . n, and n is an integer, for guiding and focusing an ion beam. The rf linac further includes a plurality of resonators each includes an inductor circuit L(k), k=1,2,3, . . . , n' where n' is a second integer, wherein the inductor circuit connected to at least two electrodes E(j'), j'=1,2,3, . . . (n−1), for applying an accelerating rf voltage thereto. Each of the electrodes E(j') disposed between and aligned with two sets of the transverse focusing lenses Lenses(j') and Lenses(j'=1), j'=1, 2,3, . . . (n−1), as a linear array. In a preferred embodiment, at least two of the adjacent electrodes E(j') and E(j'+1) are connected to a same inductor circuit L(k). In another preferred embodiment, at least two of the adjacent electrodes E(j') and E(j'+1) are connected to two different inductor circuits L(k1) and L(k2) where k1 and k2 are two different integers and k1 and k2 are smaller than n'.

These and other objects and advantages of the present invention will no doubt become obvious to those of ordinary skill in the art after having read the following detailed description of the preferred embodiment, which is illustrated in the various drawing figures.

DETAILED DESCRIPTION OF THE PREFERRED EMBODIMENT

Figure 2:
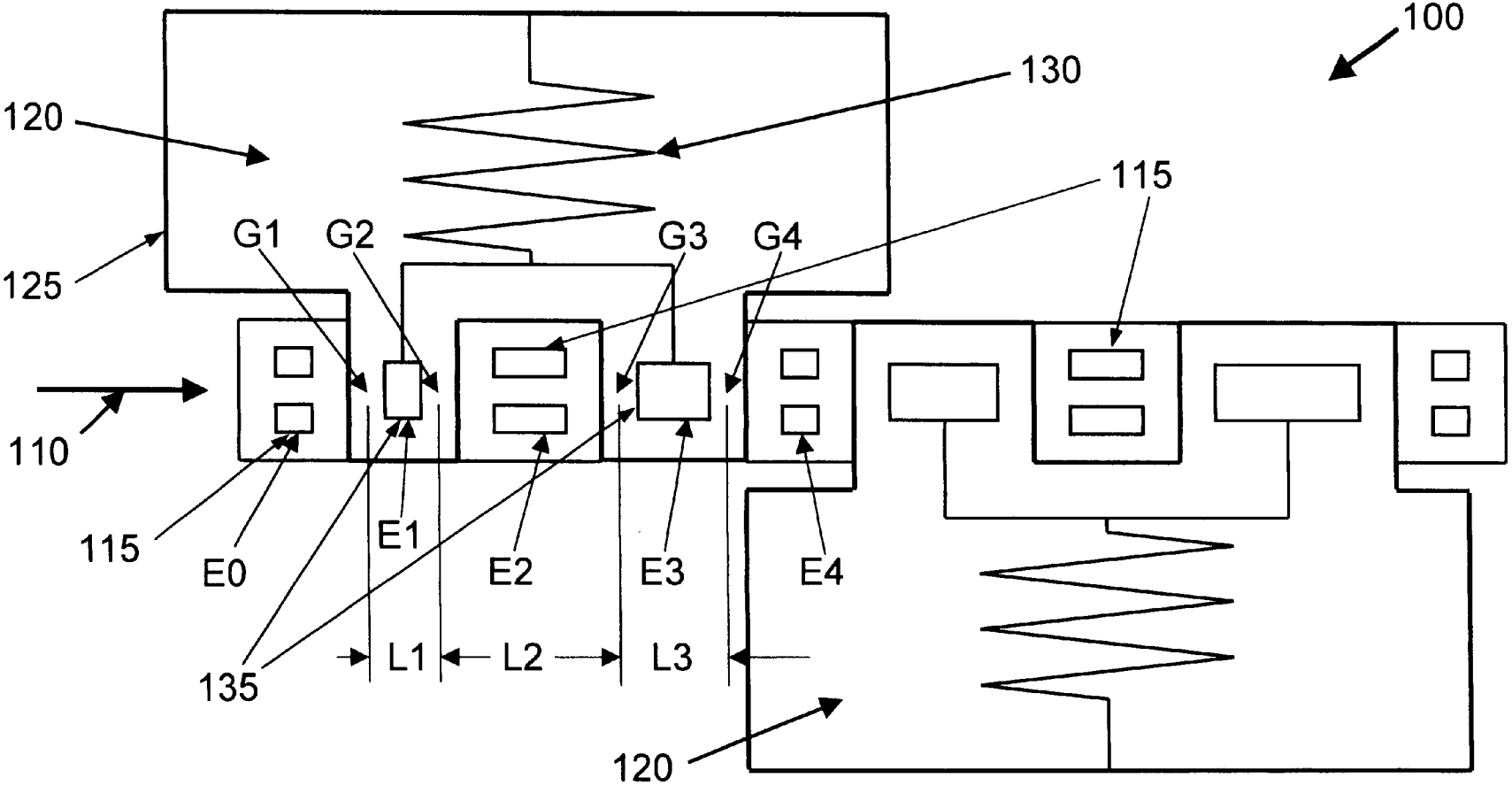
FIG. 2 is a functional block diagram of a rf linac of this invention built with double electrodes for each of the resonators.

Referring to FIG. 2 for a radio frequency (rf) linear accelerator (linac) 100 of this invention for accelerating an injected ion beam 110. The linac 100 includes a plurality sets of transverse focusing lenses 115 for guiding and focusing the injected ion beam 110 to project along a linear path. The linac 100 further includes a plurality of resonators 120 enclosed in the resonator walls 125. Each resonator 120 includes inductor (L) circuit 130 with the resonator walls 125 serving as capacitor (C) for combining into an LC circuit. Each of the inductor circuits 130 are connected to two electrodes 135 in the resonators 120 with the LC circuits to drive the electrodes 135 into a very high voltage. As that shown by the following discussion, when two electrodes are connected to a single resonator as that shown in FIG. 2, the energy gain per input power is increased by a factor of two by keeping a constant power efficiency. The number of resonators in a linac can be therefore reduced by a factor of two for the same final energy.

Figure 3:
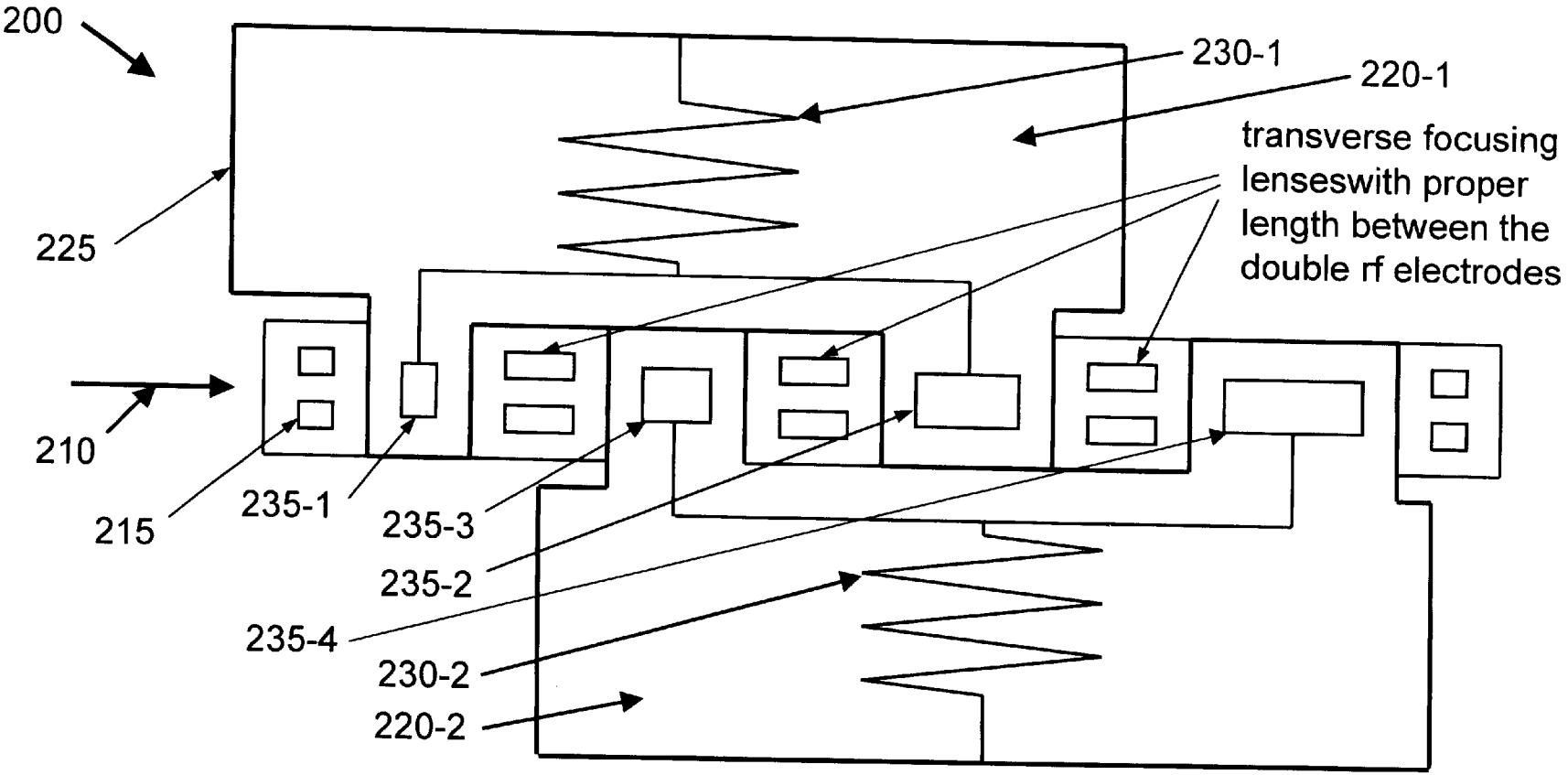
FIG. 3 is a functional block diagram of another rf linac of this invention built with double electrodes arranged with alternate neighboring configuration for each of the resonators.

There are several ways to connect a resonator with two electrodes in a linac as that shown in FIGS. 2 and 3. FIG. 2 shows a configuration with two neighboring electrodes connected to a single resonator. FIG. 3 shows a configuration with every other two neighboring electrodes connected to a resonator. In FIG. 2, since the two electrodes 135 are connected to each other and are also connected to the end of the inductive coil 130, the electrodes 135 have the same rf potential at any given time. A proper drift space is required between these two electrodes 135 in order to obtain optimal acceleration of ions.

Referring again to FIG. 2 for the descriptions of an acceleration mechanism for accelerating the ion beam 110 projected through the linac 100 employing the double-electrode resonators 120. There are four acceleration gaps in this system label as $G_1$, $G_2$, $G_3$, and $G_4$. The distances between the midpoints of these gaps are $L_1$, $L_2$, and $L_3$. The mass of a singly-charged ion of the ion beam 110 is m and its initial energy is $E_0$ (For simplicity, we will refer all ions to singly-charged ions in the following discussion). Energies inside the first electrode, the drift space between $G_2$ and $G_3$, and the second electrode are represented by $E_1$, $E_2$ and $E_3$ respectively, and the final energy is $E_4$. The energy gain $\Delta E_i$ at each gap is approximately expressed as follow, $$\Delta E_i = E_i - E_{i-1} = VT_i \cos(\phi_i), \tag{1}$$

where V is the rf amplitude for all four gaps, $\phi_i$ is the rf phase at the ith gap when the ion at the center of the gap, and $T_i$ is the transit-time factor of the ion at the ith gap. $T_i$ is a function of the ion velocity and the gap geometry. When the energy is so high that the time spent across the gap is negligible, or when the gap dimension approaches zero, $T_i$ is equal to 1. The ion energies at different locations become, $$E_i = E_{i-1} + VT_i \cos(\phi_i), \tag{2}$$

In order to obtain maximum acceleration at each gap, the rf voltage should be −V, or the rf phases should be equal to π, at $G_1$ and $G_3$ to attract positive ions towards the electrodes, and the rf voltage should be V, or the rf phase should be 2π, at $G_2$ and $G_4$ to push positive ions away from the electrodes. It indicates that the phase shift between adjacent gaps should be approximately π, or $$(2N+1)\pi = 2\pi f t_i = 2\pi f L_i / v_i,\ i=1,2,3 \tag{3}$$

where N is any integer including 0, f is the resonant frequency, $t_i$ is the traveling time of the ion across the distance $L_i$, $v_i = (2E_i/m)^{1/2}$ is the ion velocity and $E_1$ is the ion energy between $G_{i+1}$ and $G_i$. For maximum energy acceleration, ion energies are determined from Equation (2), $$E_i = E_{i-1} + VT_i, \tag{4}$$

when the initial energy $E_0$ and rf amplitude V are fixed. The final energy is, $$E_4 = E_0 + VT_1 + VT_2 + VT_3 + VT_4 \square E_0 + 4V (\text{if } T_1 \square 1), \tag{5}$$

The distances between gaps are therefore derived from Equation (3), $$L_i = (2N+1) v_i / 2f = (2N+1)(E_i/2m)^{1/2}/f. \tag{6}$$

The ion with mass m and initial energy $E_0$ that are used to determine $L_i$ in Equation (5) is called designed particle. Once $L_i$ are fixed, other ions with different masses and initial energies may not have the optimal acceleration. But if their masses and energies are close to the design particle's values, the ion beam still gains sufficient acceleration.

The energy gain of this double-electrode resonator is approximately 4V indicated by Equation (5). Considering the energy gain of the single-electrode resonator is about 2V, the double-electrode resonator actually has twice of the energy gain per resonator if the amplitude V, or the power efficiency, is unchanged.

According to FIG. 2 and the above description, this invention discloses a radio frequency (rf) linear accelerator (linac). The linac 100 includes a first set and a second set transverse focusing lenses 115 for guiding and focusing an injected ion beam 110 for transmitting along a linear path. The linac 100 further includes a resonator 120 enclosed in a resonator wall 125 wherein the resonator 120 includes an inductor (L) circuit 130. The resonator further includes a first electrode 135-1 and a second electrode 135-2, both connected to the inductor 130 for applying an accelerating rf voltage thereon. The first electrode disposed between the first set and the second set of transverse focusing lenses and the second electrode disposed next to the second set of transverse focusing lenses opposing the first electrode. As that shown in FIG. 2, the rf linac further includes a third set and a fourth set transverse focusing lenses disposed next to the second electrode for guiding and focusing an injected ion beam for transmitting along a linear path. The rf linac 100 further includes a second resonator enclosed in a second resonator wall wherein the second resonator further has a second inductor circuit The second resonator further includes a third electrode and a fourth electrode, both connected to the second inductor for applying an accelerating rf voltage thereon, wherein the third electrode disposed between the third set and the fourth set of transverse focusing lenses and the fourth electrode disposed next to the fourth set of transverse focusing lenses opposing the third electrode. In a preferred embodiment, the first set of transverse focusing lenses is disposed with a gap G1 from the first electrode, the second set of transverse focusing lenses is disposed with a gap G2 from the first electrode, the second set of transverse focusing lenses is disposed with a gap G3 from the second electrode and the second electrode is disposed with a gap G4 from the resonator wall. A midpoint of the G2 is disposed with a first distance L1 from a midpoint of the G1, a midpoint of the G3 is disposed with a second distance L2 from the midpoint of the G2, a midpoint of the G4 is disposed with a third distance L3 from the midpoint of the G3, wherein:

$$L_i = (2N+1)v_i/2f = (2N+1)\ (E_i/2m)^{1/2}/f$$

where i=1,2,3, and N is an integer, $v_i = (2E_i/m)^{1/2}$ representing an ion velocity, $E_1$ representing an ion energy between $G_{i+1}$ and $G_i$, m representing the mass of an ion of the ion beam and f representing a resonant frequency of the resonator.

In summary, a radio frequency (rf) linear accelerator (linac) is disclosed in this invention that has a resonator 120 includes an inductor (L) circuit wherein the inductor circuit 130 connected to at least two electrodes 135 for applying an accelerating rf voltage thereto. In a preferred embodiment, the resonator 120 further includes a resonant wall for enclosing the inductor circuit and the electrodes therein. The rf linac 100 further includes a plurality sets of transverse focusing lenses 115 for guiding and focusing an injected ion beam 110 wherein each of the electrodes 135 disposed between and aligned with two sets of the transverse focusing lenses 115 as a linear array. Each of the plurality sets of transverse focusing lenses 115, represented by lenses(i), i=1,2,3, . . . n, and n is an integer, is disposed with a gap G(i) from each of the electrodes. A midpoint of each of the gap G(i) is disposed at distance $L_i$ from a midpoint of next gap G(i+1) wherein:

$$L_i = (2N+1)v_i/2f = (2N+1)\ (E_i/2m)^{1/2}/f$$

where $v_i = (E_i/m)^{1/2}$ representing an ion velocity, $E_i$ representing an ion energy between the gaps G(i+1) and G(i), m representing the mass of an ion of the ion beam and f representing a resonant frequency of the resonator.

In essence, this invention discloses a radio frequency (rf) linear accelerator (linac) that includes a plurality sets of transverse focusing lenses, represented by Lenses(j), where j=1,2,3, . . . n, and n is an integer, for guiding and focusing an ion beam. The rf linac further includes a plurality of resonators each includes an inductor circuit L(k), k=1,2,3, . . . , n' where n' is a second integer, wherein the inductor circuit connected to at least two electrodes E(j'), j'=1,2,3, . . . (n−1), for applying an accelerating rf voltage thereto. Each of the electrodes E(j') disposed between and aligned with two sets of the transverse focusing lenses Lenses(j') and Lenses(j+1), j'=1,2,3, . . . (n−1), as a linear array. In a preferred embodiment, at least two of the adjacent electrodes E(j') and E(j'+1) are connected to a same inductor circuit L(k). In another preferred embodiment, at least two of the adjacent electrodes E(j') and E(j'+1) are connected to two different inductor circuits L(k1) and L(k2) where k1 and k2 are two different integers and k1 and k2 are smaller than n'.

A method of configuring a radio frequency (rf) linear accelerator (linac) is also disclosed in this invention. The method includes steps of: (a) disposing a first set and a second set transverse focusing lenses for guiding and focusing an ion beam;(b) enclosing a resonator with an inductor circuit (L) in a resonator wall; (c) connecting a first electrode and a second electrode to the inductor for applying an accelerating rf voltage thereon and disposing the first electrode between the first set and the second set of transverse focusing lenses and disposing the second electrode next to the second set of transverse focusing lenses opposing the first electrode. In a preferred embodiment, the method further includes steps of (d) disposing a third set and a fourth set transverse focusing lenses next to the second electrode for guiding and focusing the ion beam; (e) enclosing a second resonator with a second inductor circuit (L) in a resonator wall; (f) connecting a third electrode and a fourth electrode to the second inductor for applying a second accelerating rf voltage thereon and disposing the third electrode between the third set and the fourth set of transverse focusing lenses and disposing the fourth electrode next to the fourth set of transverse focusing lenses opposing the third electrode. In a preferred embodiment, the step of disposing the first set of transverse focusing lenses is a step of disposing the first set of transverse focusing lenses with a gap G1 from the first electrode, the step of disposing the second set of transverse focusing lenses is a step of disposing the second set of transverse focusing lenses with a gap G2 from the first electrode, the step of disposing the second electrode is a step of disposing the second electrode with a gap G3 from the second set of transverse focusing lenses and disposing the second electrode with a gap G4 from the resonator wall. The step of disposing the first and second electrodes further comprising a step of disposing a midpoint of the G2 with a first distance L1 from a midpoint of the G1, disposing a midpoint of the G3 is with a second distance L2 from the midpoint of the G2, disposing a midpoint of the G4 is with a third distance L3 from the midpoint of the G3, wherein:

$$L_i = (2N+1)v_i/2f = (2N+1)\ (E_i/2m)^{1/2}/f$$

where j=1,2,3, and N is an integer, $v_i = (2E_i/m)^{1/2}$ representing an ion velocity, $E_1$ representing an ion energy between $G_{i+1}$ and $G_i$, m representing the mass of an ion of the ion beam and f representing a resonant frequency of the resonator.

In summary, this invention discloses a method of configuring a radio frequency (rf) linear accelerator (linac) that includes a step of disposing an inductor (L) circuit in a resonator and connecting the inductor circuit to at least two electrodes for applying an accelerating rf voltage thereto. The method further includes a step of enclosing the resonator with the inductor circuit and the electrodes in a resonant wall. In a preferred embodiment, the method further includes a step of disposing a plurality sets of transverse focusing lenses by arranging each of the electrodes disposed between and aligned with two sets of the transverse focusing lenses as a linear array for guiding and focusing an injected ion beam. In a preferred embodiment, the step of disposing the sets of transverse focusing lenses comprising a step of disposing each of the plurality sets of transverse focusing lenses, represented by lenses(i), i=1,2,3, . . . n, and n is an integer, with a gap G(i) from each of the electrodes, and disposing a midpoint of each of the gap G(i) at distance Li from a midpoint of next gap G(i+1) wherein:

$$L_i = (2N+1)v_i/2f = (2N+1)\ (E_i/2m)^{1/2}/f$$

where $v_i = (E_i/m)^{1/2}$ representing an ion velocity, $E_i$ representing an ion energy between the gaps G(i+1) and G(i), m representing the mass of an ion of the ion beam and f representing a resonant frequency of the resonator.

Figure 1:
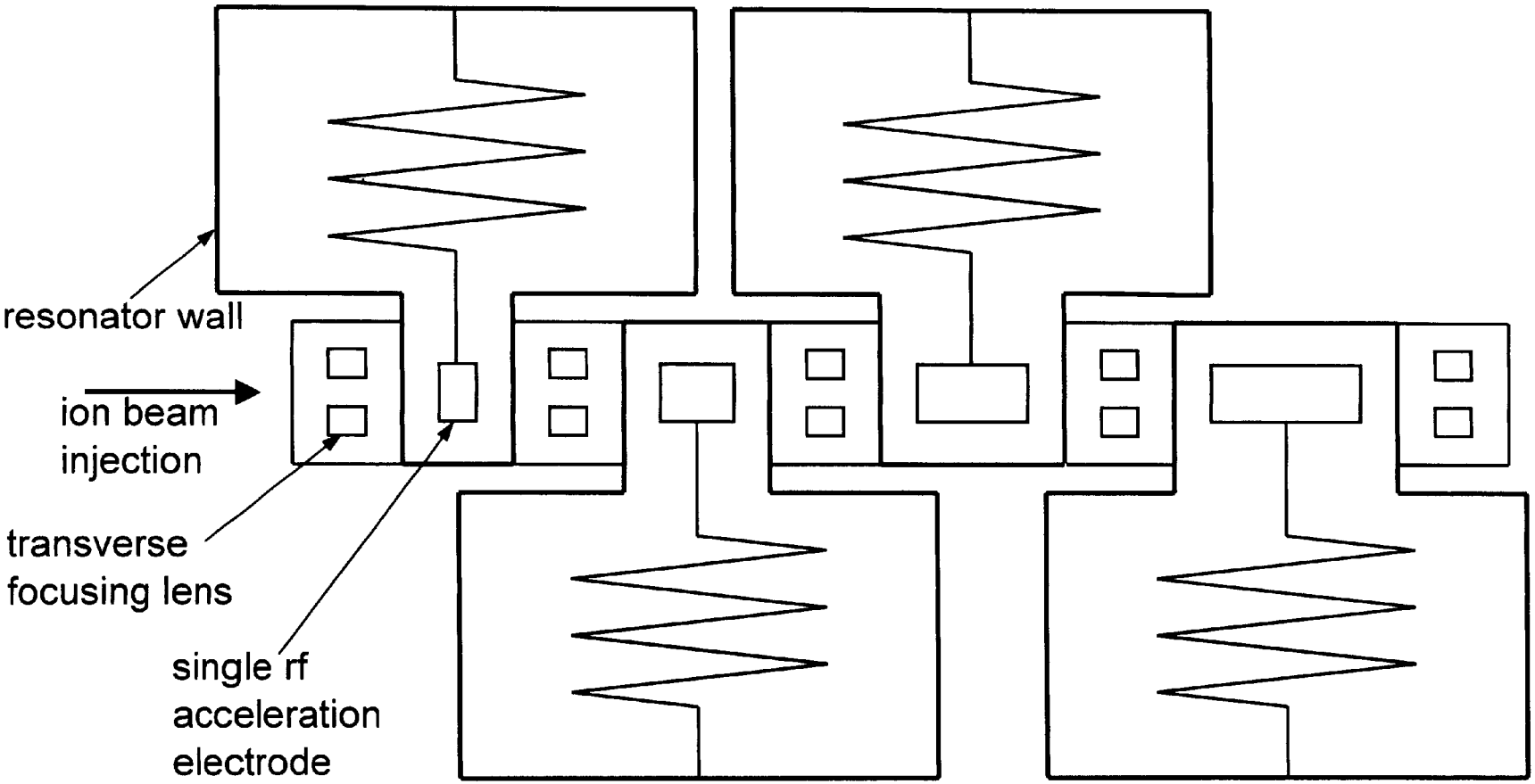
Figure 1. (Prior Art)
FIG. 1 is a functional block diagram of a conventional rf linac built with single electrode resonators.

Resonator capacitance is one of the major factors affecting resonator efficiency. A larger resonator has lower capacitance because of the larger distance between the inductive circuit 130 and the resonator walls 125. A double-electrode resonator has much bigger volume with a longer distance between the resonator wall and the inductive circuit than that of the single electrode resonator without interfering other neighboring resonators by comparing the sizes of the resonators shown in FIG. 1 and FIG. 2. The additional capacitance introduced by the second electrode is well compensated by the smaller capacitance between the coils and the walls. Therefore, the efficiency of the double electrode resonator would be similar to the single electrode resonator. There are many ways to connect an rf circuit to two or more rf electrodes. FIG. 3 shows another preferred embodiment of a linac 200 with two resonators 220-1 and 220-2. The inductive circuits of these resonators are connected to two electrodes. Instead of connection to neighboring electrodes as that arranged in FIG. 2, the inductive circuits 230-1 and 230-2, as shown in FIG. 3, are connected to electrodes 235-1,235-3 and 235-2, 235-4 respectively. This configuration has the advantage that the resonators 220 have a smaller capacitance between the inductive circuits 230 and the resonator walls 225. According to FIG. 3, this invention discloses a radio frequency (rf) linear accelerator (linac) that includes fours sets of transverse focusing lenses represented by Lenses(j'), where j=1,2,3,4, for guiding and focusing an ion beam. The rf linac further includes a first and a second resonators each enclosed in a resonator wall. Each of the first and second resonators includes an inductor circuit L(k), k=1,2; wherein the inductor circuit L(1) connected to two electrodes E(j') where j'=1, and 3, and L(2) connected to E(j') where j'=2, and 4, for applying an accelerating rf voltage thereto. Each of the electrodes E(j') disposed between and aligned with two sets of the transverse focusing lenses Lenses(j') and Lenses(j'+1), j'=1,2,3, as a linear array. In a preferred embodiment, Each of the four sets of transverse focusing lenses, represented Lenses(j) is disposed with a gap G(i) from each of the electrodes E(j'), a midpoint of each of the gap G(i) is disposed at distance Li from a midpoint of next gap G(i+1) wherein:

$$L_i = (2N+1)v_i/2f = (2N+1)\ (E_i/2m)^{1/2}/f$$

where $v_i\ (E_i/m)^{1/2}$ representing an ion velocity, $E_i$ representing an ion energy between the gaps G(i+1) and G(i), m representing the mass of an ion of the ion beam and f representing a resonant frequency of the resonator.

According to FIGS. 2 and 3, and above descriptions, a method of configuring a radio frequency (rf) linear accelerator (linac) is disclosed that includes steps of (a) disposing fours sets of transverse focusing lenses 441 represented by Lenses(j'), where j=1,2,3,4, for guiding and focusing an ion beam; (b) enclosing a first and a second resonators in resonator walls; (c) including in each of the first and second resonators an inductor circuit L(k), k=1,2; and connecting the inductor circuit L(1) to two electrodes E(j') where j'=1, and 3, and connecting the inductor circuit L(2) to two electrodes E(j') where j'=2, and 4, for applying an accelerating rf voltage thereto; and (d) disposing each of the electrodes E(j') between and aligned with two sets of the transverse focusing lenses Lenses(j') and Lenses(j'+1), j'=1, 2,3, as a linear array. In a preferred embodiment, the method further includes a step (e) disposing a plurality sets of transverse focusing lenses, represented by Lenses(j'), where j=1,2,3, . . . n, and n is an integer, for guiding and focusing an ion beam; (f) forming a plurality of resonators by including an inductor circuit L(k), k=1,2,3, . . . , n' where n' is a second integer, in each of the resonators and connecting each of the inductor circuits to at least two electrodes E(j'), j'=1,2,3, . . . (n−1), for applying an accelerating rf voltage thereto; (g) disposing each of the electrodes E(j') between and aligned with two sets of the transverse focusing lenses Lenses(j') and Lenses(j'+1), j'=1,2,3, . . . (n−1), as a linear array. In a preferred embodiment, the step of connecting the inductor circuit to the electrodes further comprising a step of connecting at least two of the adjacent electrodes E(j') and E(j'+1) to a same inductor circuit L(k). In another preferred embodiment, the step of connecting the inductor circuit to the electrodes further comprising a step of connecting at least two of the adjacent electrodes E(j') and E(j'+1) to two different inductor circuits L(k1) and L(k2) where k1 and k2 are two different integers and k1 and k2 are smaller than n'. In another preferred embodiment, the step of disposing each of the four sets of transverse focusing lenses, represented Lenses(j) is a step of disposing the four set of transverse focusing lenses with a gap G(i) from each of the electrodes E(j'), and disposing a midpoint of each of the gap G(i) at distance Li from a midpoint of next gap G(i+1) wherein:

$$L_i = (2N+1)v_i/2f = (2N+1)\ (E_i/2m)^{1/2}/f$$

where $v_i\ (E_i/m)^{1/2}$ representing an ion velocity, $E_i$ representing an ion energy between the gaps G(i+1) and G(i), m representing the mass of an ion of the ion beam and f representing a resonant frequency of the resonator.

The description of a linac with multiple resonators, with each resonator connecting to two or more rf electrodes, is similar to the description above of a linac with two resonators, since any two neighboring resonators in a linac with multiple resonators is indeed a linac with two resonators.

In essence, this invention discloses a method of configuring a radio frequency (rf) linear accelerator (linac) that includes steps of (a) employing a plurality sets of transverse focusing lenses for guiding and focusing an injected ion beam to project along a linear path; and (b) enclosing a plurality of resonators in a resonator wall and connecting an inductor circuit in each of the resonators to at least two electrodes for applying an rf accelerating voltage thereon.

By properly choosing the distances $L_i$ between gaps in the double-electrode resonators, the designed ions can be accelerated to the energy similar to the LINAC with single-electrode resonators. A linac built with double-electrode resonators can cut the number of rf resonators by a factor of two to reduce the cost of a high energy ion implanter substantially and reduce power consumption by resonators.

In principle, it is possible to connect three electrodes to a resonator. However, the linac flexibility of accelerating ions with different masses and energies is reduced. The triple electrode rf resonator will be a good choice for a linac to be designed to accelerate ions with a narrow range of ion-to-charge ratio.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

I claim:

1. A radio frequency (rf) linear accelerator (linac) comprising:

a resonator enclosed in a resonator wall;

said resonator includes an inductor (L) circuit;

a first set and a second set transverse focusing lenses for guiding and focusing an injected ion beam for transmitting along a linear path;

said resonator further includes a first electrode and a second electrode, both connected to said inductor for applying an accelerating rf voltage thereon, wherein said first electrode disposed between said first set and said second set of transverse focusing lenses and said second electrode disposed next to said second set of transverse focusing lenses opposing said first electrode.

2. The rf linac of claim 1 further comprising:

a second resonator enclosed in a second resonator wall;

said second resonator includes a second inductor (L) circuit;

a third set and a fourth set transverse focusing lenses disposed next to said second electrode for guiding and focusing an injected ion beam for transmitting along a linear path;

said second resonator further includes a third electrode and a fourth electrode, both connected to said second inductor for applying an accelerating rf voltage thereon, wherein said third electrode disposed between said third set and said fourth set of transverse focusing lenses and said fourth electrode disposed next to said fourth set of transverse focusing lenses opposing said third electrode.

3. The rf linac of claim 1 wherein:

said first set of transverse focusing lenses is disposed with a gap G1 from said first electrode, said second set of transverse focusing lenses is disposed with a gap G1 from said first electrode, said second set of transverse focusing lenses is disposed with a gap G3 from said second electrode and said second electrode is disposed with a gap G4 from said resonator wall; and a midpoint of said G2 is disposed with a first distance L1 from a midpoint of said G1, a midpoint of said G3 is disposed with a second distance L2 from said midpoint of said G2, a midpoint of said G4 is disposed with a third distance L3 from said midpoint of said G3, wherein:

$$L_i = (2N+1)\, v_i/2f = (2N+1)\, (E_i/2m)^{1/2}/f$$

where i=1,2,3, and N is an integer, $v_i = (2E_i/m)^{1/2}$ representing an ion velocity, $E_i$ representing an ion energy between $G_{i+1}$ and $G_i$, m representing the mass of an ion of the ion beam and f representing a resonant frequency of the resonator.

4. A radio frequency (rf) linear accelerator (linac) comprising:

a resonator includes an inductor (L) circuit wherein said inductor circuit connected to at least two electrodes for applying an accelerating rf voltage thereto;

said resonator further includes a resonant wall for enclosing said inductor circuit and said electrodes therein; and a plurality sets of transverse focusing lenses for guiding and focusing an injected ion beam wherein each of said electrodes disposed between and aligned with two sets of said transverse focusing lenses as a linear array.

5. The rf linac of claim 4 wherein:

each of said plurality sets of transverse focusing lenses, represented by lenses(i), i=1,2,3, . . . n, and n is an integer, is disposed with a gap G(i) from each of said electrodes a midpoint of each of said gap G(i) is disposed at distance Li from a midpoint of next gap G(i+1) wherein:

$$L_i = (2N+1) v_i/2f = (2N+1)\, (Ei/2m)^{1/2}/f$$

where $v_i = (2E_i/m)^{1/2}$ representing an ion velocity, $E_i$ representing an ion energy between the gaps G(i+1) and G(i), m representing a mass of an ion of said ion beam and f representing a resonant frequency of said resonator.

6. A radio frequency (rf) linear accelerator (linac) comprising:

a plurality sets of transverse focusing lenses, represented by Lenses(j), where j=1,2,3, . . . n, and n is an integer, for guiding and focusing an ion beam;

a plurality of resonators each includes an inductor circuit L(k), k=1,2,3, . . . , n' where n' is a second integer, wherein said inductor circuit connected to at least two electrodes E(j'), j'=1,2,3, . . . (n−1), for applying an accelerating rf voltage thereto;

each of said electrodes E(j') disposed between and aligned with two sets of said transverse focusing lenses Lenses (j') and Lenses(j'+1), j'=1,2,3, . . . (n−1)as a linear array.

7. The rf linac of claim 6 wherein:

at least two of said adjacent electrodes E(j') and E(j'+1) are connected to a same inductor circuit L(k).

8. The rf linac of claim 6 wherein:

at least two of said adjacent electrodes E(j') and E(j'+1) are connected to two different inductor circuits L(k1) and L(k2) where k1 and k2 are two different integers and k1 and k2 are smaller than n'.

9. A radio frequency (rf) linear accelerator (linac) comprising:

four sets of transverse focusing lenses represented by Lenses(j'), where j=1,2,3,4, for guiding and focusing an ion beam;

a first and a second resonators each enclosed in a resonator wall;

each of said first and second resonators includes an inductor circuit L(k), k=1,2; wherein said inductor circuit L(1) connected to two electrodes E(j') where j'=1, and 3, and E L(2) connected to E(j') where j'=2, and 4, for applying an accelerating rf voltage thereto; and each of said electrodes E(j') disposed between and aligned with two sets of said transverse focusing lenses Lenses (j') and Lenses(j'+1), j'=1,2,3, as a linear array.

10. The rf linac of claim 9 wherein:

each of said four sets of transverse focusing lenses, represented Lenses(j) is disposed with a gap G(i) from each of said electrodes E(j'), a midpoint of each of said gap G(i) is disposed at distance $L_i$ from a midpoint of next gap G(i+1) wherein:

$$L_i = (2N+1)v_i/2f = (2N+1)\ (E_i/2m)^{1/2}/f$$

where $v_i = (2E_i\ /m)^{1/2}$ representing an ion velocity, $E_i$ representing an ion energy between said gaps G(i+1) and G(i), m representing the mass of an ion of said ion beam and f representing a resonant frequency of said resonator.

11. A method of configuring a radio frequency (rf) linear accelerator (linac) comprising:

disposing a first set and a second set transverse focusing lenses for guiding and focusing an ion beam;

enclosing a resonator with an inductor circuit (L) in a resonator wall;

connecting a first electrode and a second electrode to said inductor for applying an accelerating rf voltage thereon and disposing said first electrode between said first set and said second set of transverse focusing lenses and disposing said second electrode next to said second set of transverse focusing lenses opposing said first electrode.

12. The method of configuring the rf linac of claim 11 further comprising:

disposing a third set and a fourth set transverse focusing lenses next to said second electrode for guiding and focusing said ion beam;

enclosing a second resonator with a second inductor circuit (L) in a resonator wall;

connecting a third electrode and a fourth electrode to said second inductor for applying a second accelerating rf voltage thereon and disposing said third electrode between said third set and said fourth set of transverse focusing lenses and disposing said fourth electrode next to said fourth set of transverse focusing lenses opposing said third electrode.

13. The method of configuring the rf linac of claim 11 wherein:

said step of disposing said first set of transverse focusing lenses is a step of disposing said first set of transverse focusing lenses with a gap G1 from said first electrode, said step of disposing said second set of transverse focusing lenses is a step of disposing said second set of transverse focusing lenses with a gap G2 from said first electrode, said step of disposing said second electrode is a step of disposing said second electrode with a gap G3 from said second set of transverse focusing lenses and disposing said second electrode with a gap G4 from said resonator wall; and said step of disposing said first and second electrodes further comprising a step of disposing a midpoint of said G2 with a first distance L1 from a midpoint of said G1, disposing a midpoint of said G3 is with a second distance L2 from said midpoint of said G2, disposing a midpoint of said G4 is with a third distance L3 from said midpoint of said G3, wherein:

$$L_i = (2N+1)v_i/2f = (2N+1)\ (E_i/2m)^{1/2}/f$$

where i=1,2,3, and N is an integer, $v_i = (2E_i\ /m)^{1/2}$ representing an ion velocity, $E_1$ representing an ion energy between $G_{i+1}$ and $G_i$, m representing a mass/chargeratio of an ion of said ion beam and f representing a resonant frequency of said resonator.

14. A method of configuring a radio frequency (rf) linear accelerator (linac) comprising:

disposing an inductor (L) circuit in a resonator and connecting said inductor circuit to at least two electrodes for applying an accelerating rf voltage thereto;

enclosing said resonator with said inductor circuit and said electrodes in a resonant wall; and disposing a plurality sets of transverse focusing lenses by arranging each of said electrodes disposed between and aligned with two sets of said transverse focusing lenses as a linear array for guiding and focusing an injected ion beam.

15. The method of configuring the rf linac of claim 14 wherein:

said step of disposing said sets of transverse focusing lenses comprising a step of disposing each of said plurality sets of transverse focusing lenses, represented by lenses(i), i=1,2,3, . . . n, and n is an integer, with a gap G(i) from each of said electrodes, and disposing a midpoint of each of said gap G(i) at distance Li from a midpoint of next gap G(i+1) wherein:

$$L_i = (2N+1)v_i/2f = (2N+1)\ (2E_i/2m)^{1/2}/f$$

where $v_i = (E_i\ /m)^{1/2}$ representing an ion velocity, $E_i$ representing an ion energy between said gaps G(i+1) and G(i), m representing said mass of an ion of said ion beam and f representing a resonant frequency of said resonator.

16. A method of configuring a radio frequency (rf) linear accelerator (linac) comprising:

disposing a plurality sets of transverse focusing lenses, represented by Lenses(j), where j=1,2,3, . . . n, and n is an integer, for guiding and focusing an ion beam;

forming a plurality of resonators by including an inductor circuit L(k), k=1,2,3, . . . , n' where n' is a second integer, in each of said resonators and connecting each of said inductor circuits to at least two electrodes E(j'), j'=1,2,3, . . . (n−1), for applying an accelerating rf voltage thereto;

disposing each of said electrodes E(j') between and aligned with two sets of said transverse focusing lenses Lenses(j') and Lenses(j'+1), j'=1,2,3, . . . (n−1), as a linear array.

17. The method of configuring the rf linac of claim 16 wherein:

said step of connecting said inductor circuit to said electrodes further comprising a step of connecting at least two of said adjacent electrodes E(j') and E(j'+1) to a same inductor circuit L(k).

18. The method of configuring the rf linac of claim 16 wherein:

said step of connecting said inductor circuit to said electrodes further comprising a step of connecting at least two of said adjacent electrodes E(j') and E(j'+1) ar to two different inductor circuits L(k1) and L(k2) where k1 and k2 are two different integers and k1 and k2 are smaller than n'.

19. A method of configuring a radio frequency (rf) linear accelerator (linac) comprising:

disposing four sets of transverse focusing lenses represented by Lenses (j), where j=1,2,3,4, for guiding and focusing an ion beam;

enclosing a first and a second resonators in resonator walls;

including in each of said first and second resonators an inductor circuit L(k), k=1,2; and connecting said inductor circuit L(1) to two electrodes E(j') where j'=1, and 3, and connecting said inductor circuit L(2) to two electrodes E(j') where j'=2, and 4, for applying an accelerating rf voltage thereto; and disposing each of said electrodes E(j') between and aligned with two sets of said transverse focusing lenses Lenses(j') and Lenses(j'+1), j'=1,2,3, as a linear array.

20. The method of configuring the rf linac of claim 19 wherein:

said step of disposing each of said four sets of transverse focusing lenses, represented Lenses(j) is a step of disposing said four set of transverse focusing lenses with a gap G(i) from each of said electrodes E(j'), and disposing a midpoint of each of said gap G(i) at distance Li from a midpoint of next gap G(i+1) wherein:

$$L_i = (2N+1)v_i/2f = (2N+1)\,(E_i/2m)^{1/2}/f$$

where $v_i=(2E_i/m)^{1/2}$ representing an ion velocity, $E_i$ representing an ion energy between said gaps G(i+1) and G(i), m representing the mass of an ion of said ion beam and f representing a resonant frequency of said resonator.

* * * * *